US006619563B2

(12) United States Patent
van der Steur

(10) Patent No.: US 6,619,563 B2
(45) Date of Patent: Sep. 16, 2003

(54) MANIFOLD BLOCK FOR FLOW CONTROL IN COATING APPLICATIONS

(75) Inventor: Gunnar van der Steur, Chesapeake City, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 59 days.

(21) Appl. No.: 09/854,098

(22) Filed: May 14, 2001

(65) Prior Publication Data

US 2002/0166899 A1 Nov. 14, 2002

(51) Int. Cl.[7] ..... B05B 9/00; B05B 1/30; B05B 15/08

(52) U.S. Cl. ..... 239/125; 239/124; 239/126; 239/587.6; 239/569

(58) Field of Search ..... 239/124, 125, 239/127, 126, 106, 110, 119, 93, 569, 587.6, 596, 600, 549, 390

(56) References Cited

U.S. PATENT DOCUMENTS 4,657,047 A * 4/1987 Kolibas ..... 137/881
4,907,741 A * 3/1990 McIntyre ..... 239/124
5,458,291 A * 10/1995 Brusko et al. ..... 239/423
5,520,790 A * 5/1996 Chopas et al. ..... 204/620
5,636,790 A * 6/1997 Brusko et al. ..... 239/124
5,931,355 A * 8/1999 Jefferson ..... 222/413
6,315,209 B1 * 11/2001 Tripp ..... 236/12.16

* cited by examiner

*Primary Examiner*—Davis Hwu
(74) *Attorney, Agent, or Firm*—E. Alan Uebler, PA

(57) ABSTRACT

A manifold block for controlling the flow of liquids and useful in the application of paint to automotive vehicles and in other, similar, applications is provided. The manifold block houses at least one liquid inlet supply channel, at least one liquid outlet return channel, and an applicator channel in microvalved connection with the inlet channel and the outlet channel, which channels meet at a common intersection in adjacent proximity to the microvalve. Stagnation in any of the channels in either the "open" or "closed" mode of operation of the microvalve is substantially eliminated. A stacked array of a plurality of these manifold blocks may be interconnected through a common applicator channel.

10 Claims, 6 Drawing Sheets

MANIFOLD BLOCK FOR FLOW CONTROL IN COATING APPLICATIONS

BACKGROUND OF THE INVENTION

This invention relates to a manifold block for use in controlling the flow therethrough, through different channels, of a plurality of liquids having distinct physical and/or chemical properties. The block is especially suited for controlling the flow of paint delivered to a spray atomizer from a plurality of different color paint source reservoirs, which paint is applied to vehicles in the automotive industry. The manifold block is not limited, however, to the spray painting field, but will find uses in applications of other substances, viz. dyes, acids, caustics, fragrances, soaps and detergents, processing chemicals, and other, similar liquids, powder for powder coating applications or gases. Herein, the manifold block will be described with reference to paint spraying and automotive finishing, and it will be understood that the same or similar descriptions and principles of operation also apply when this manifold block is used to control the application of the aforesaid diverse substances.

In the application of paint in the automotive finishing industry, the paint may be delivered to an atomizer from a plurality of sources, each of a different color, via a bank of stackable manifolds, one of which is depicted in FIG. 1 and labeled "Prior Art". This manifold will be described in detail below. Each block manifold contains at least one inlet supply line and at least one return line, per color, and the flow is controlled by a microvalve (conventional) which is triggered (controlled on-off) by an air pilot line, one per valve. The microvalves are housed within the manifold block as shown in FIGS. 1 and 2. Each color of paint recirculates into and out of the manifold until the microvalve for activation of the application of that color is triggered by the air pilot line, opening the channel to the paint applicator line leading to the paint spray atomizer. When a particular color is not being applied, the paint is allowed to recirculate continuously through the manifold to ensure that the paint will maintain its consistency, e.g., its temperature, viscosity, etc., to provide uniform flow properties throughout the application process.

In the prior, known manifold shown in FIGS. 1 and 2, the supply and return lines 52, 54 within the manifold block are connected within the block as shown, and the paint is channeled, on demand, by the microvalve 40, to and through a third channel 53, and thence to the spray atomizer (not shown) through applicator channel 38. As can be seen, when the paint is continuously recirculating through the supply and return lines, this third channel contains stagnant liquid. This "dead space" within this third channel can be detrimental to the entire operation because it can cause the physical properties of the paint to degrade over time, resulting in nonuniformities and flaws in the applied coatings.

In addition, known color-change blocks generally have their paint supply and return lines, which are usually made of nylon or Teflon®, attached by means of compression fittings 36. These compression fittings hold the tubings securely to the color blocks, but they can be difficult to tighten or loosen, and this is especially so when the block assemblies are housed within a robot arm, as they often are in automotive paint applications.

In addition, in these known color change blocks, the paint supply and return lines, during the application process, are often broken at the top of the compression fitting resulting from the robot maneuvering around the article being painted, which causes these lines to bend, flex and twist repeatedly. This bending and twisting causes the paint lines to break at the top of their fittings because these fittings do not allow rotation of the hoses within the fittings.

The aforesaid problems associated with the prior color block manifolds are all obviated by the manifold block of the present invention.

SUMMARY OF THE INVENTION

A manifold block for controlling the flow of liquids in various applications is provided. The block is especially suited for applying paint to vehicles in the automotive industry, but it may be used in various other applications of liquids to substrates. The manifold block houses at least one liquid inlet supply channel, at least one liquid outlet return channel, and an applicator channel in microvalved connection with the inlet channel and the outlet channel. The inlet, outlet and applicator channels meet at a common intersection in adjacent proximity to the microvalve. When the microvalve is triggered to its "open" position, the liquid flows through the inlet channel, to and through the applicator channel, with a portion thereof flowing to and through the outlet channel. When the microvalve is triggered to the "closed" position, the liquid flows to and through the inlet channel, and to and through the outlet channel, with no liquid flow to or through the applicator channel. This operation substantially eliminates stagnation in any of the channels in either the "open" or "closed" mode of operation of the microvalve.

The manifold block may have a plurality of paired inlet channels and outlet channels, wherein each inlet channel meets its paired outlet channel at a common microvalved intersection of these channels with the applicator channel in adjacent proximity to one of a plurality of microvalves. A preferred manifold block has two sets of paired inlet channels and outlet channels, each inlet channel meeting its paired outlet channel at a common microvalved intersection of these channels with the applicator channel in adjacent proximity to one of a pair of microvalves.

A stacked array of a plurality of the manifold blocks may be interconnected through a common applicator channel.

Preferably, the manifold block has liquid supply lines and liquid return lines connected, respectively, to the inlet channels and outlet channels by means of push fittings, and the block has incorporated therein a manually operated piston valve, channeled to interconnect the inlet, outlet and applicator channels in an operational mode, and to interconnect only the inlet and outlet channels, but isolating and closing off the applicator channel, in a nonoperational mode. This valve enables stoppage of flow to the applicator channel while simultaneously allowing recirculation of flow through the inlet and outlet channels and thus enables replacement of the microvalve with minimal disruption of operation and spillage of liquid, when configured to the nonoperational mode. The manual piston valve includes means for twisting it 90° about its axis, to thereby transform the valve from its operational mode to its nonoperational mode.

The manifold block is useful in the application of paint to automotive vehicles and in various other coatings applications including dyestuffs, acids, caustics, fragrances, soaps, processing chemicals and similar liquids and gases.

DETAILED DESCRIPTION OF THE INVENTION AND PREFERRED EMBODIMENTS WITH REFERENCE TO THE DRAWINGS

A manifold block for controlling the flow of liquids and useful in the application of paint to automotive vehicles and in other applications is provided. The manifold block houses at least one liquid inlet supply channel, at least one liquid outlet return channel, and an applicator channel in microvalved connection with the inlet channel and the outlet channel, which channels meet at a common intersection in adjacent proximity to the microvalve. Stagnation in any of the channels in either the "open" or "closed" mode of operation of the microvalve is substantially eliminated. A stacked array of a plurality of these manifold blocks may be interconnected through a common applicator channel, and novel and useful auxiliary fittings and valves are provided, all as described in detail below.

Figure 1:
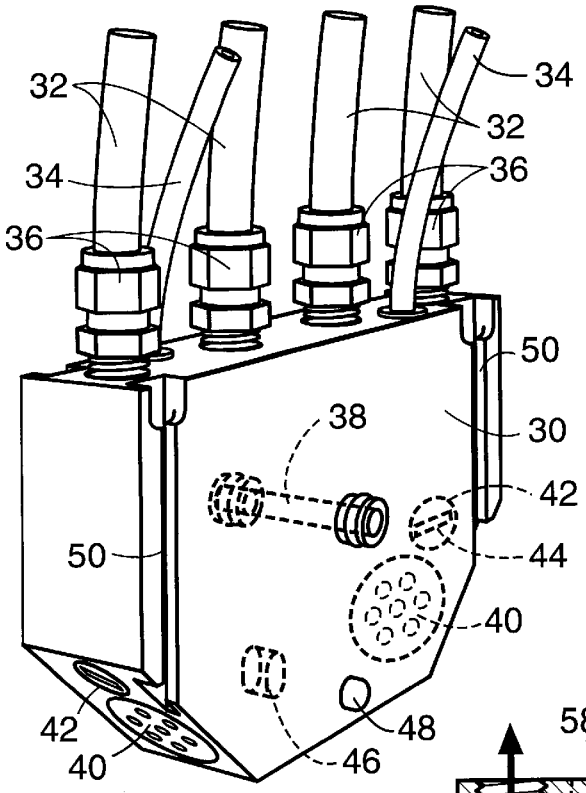
Fig. 1. Prior Art
FIG. 1 is a perspective view of a manifold block used in the application of paint to vehicles in the automotive industry, and known in the art.

A detailed description of the invention and its preferred embodiments is best provided with reference to the drawings. Before discussing the specific details of the invention, reference is drawn to FIG. 1 which illustrates a known manifold block used in the automotive industry for delivering different colors of paint to a paint atomizer. In FIG. 1 there is shown block housing 30 into which are connected paint supply and return lines 32, in this illustration four in total, comprising two sets of paired supply and return lines. Each manifold block also houses a controlling microvalve 40 which controls the flow of paint through its respective pair of supply and return paint lines 32. Two microvalves 40 are depicted in FIG. 1, one for controlling each pair of supply and return lines 32, each valve being actuated to its "on" or "off" position by controlled air lines 34. In operation, and when at least one paint supply line is opened, paint flows from the supply reservoir through one of the supply lines 32 and is directed to the applicator channel 38 which connects to the atomizer, not shown. Also included in FIG. 1, for completeness, are compression fittings 36, manual shut off valves 42, aligning indent 46 and detent 48, and key ways 50, all described more fully below.

Figure 2A:
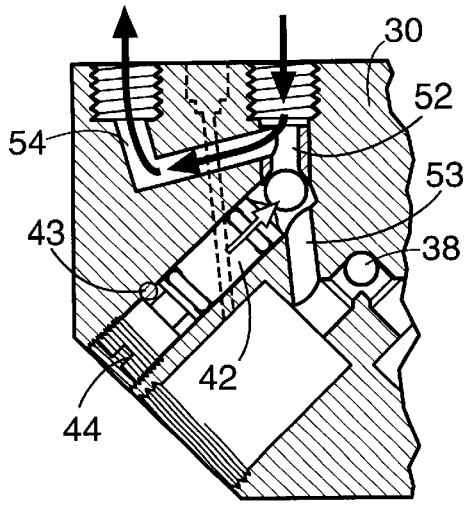
Fig. 2A. Prior Art
FIG. 2A is a partial cross-section of the left-hand half of FIG. 2 illustrating continuously recirculating flow and shut off of the microvalve shown.
Figure 2:
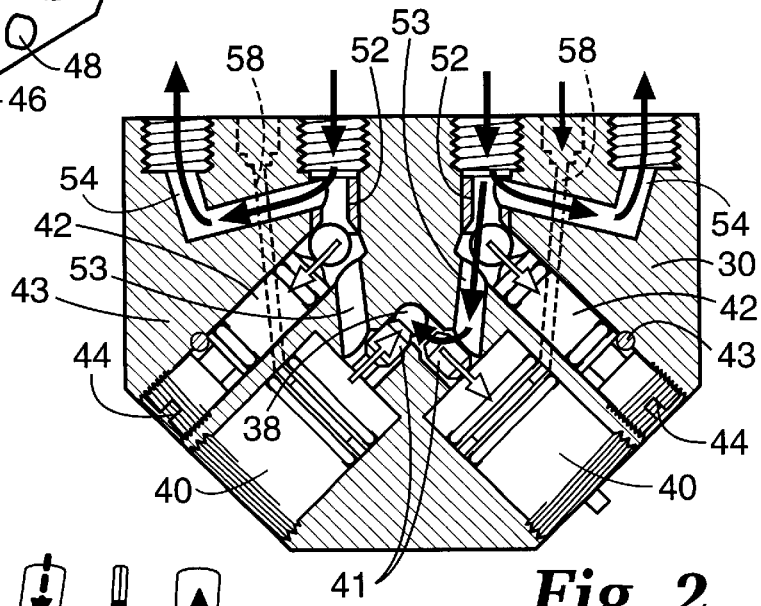
Fig. 2. Prior Art
FIG. 2 is a cross-section of the manifold block shown in FIG. 1.

FIG. 2 is a cross-section of the manifold block depicted in FIG. 1. Therein the flow paths of paint supplied into and recirculating out of the manifold block are illustrated. Paint enters from a supply line 32 into an inlet channel 52 and is directed either to the applicator channel 38 through one connecting channel 53 or is directed to and through an outlet channel 54. In FIG. 2, in the left-hand pair of inlet and outlet channels 52, 54, all paint is recirculating from the supply line 52 back to the return line 54. In the right-hand pair of inlet and outlet channels 52, 54, paint is directed from the supply line to inlet channel 52 and then into and through connecting channel 53 leading to the applicator channel 38. Flow to channels 54 (return) and/or 53 (connecting) is controlled by the microvalves 40. As needed in any given line, paint is supplied on demand from a specific supply inlet to the applicator channel 38 by control of the appropriate, air-actuated microvalve 40, and a typical flow pattern is indicated by the arrows shown in FIG. 2.

For the left hand pair of supply and return lines 32, the arrows shown indicate that paint enters at the inboard portal and flows into and through inlet channel 52, thence to and through return outlet channel 54, thereby recirculating all of the paint entering therein. Microvalve 40 is in the closed position, thereby preventing paint from entering connecting channel 53 and the common applicator channel 38. The paint already present within channel 38 remains there in stagnation.

For the right hand pair of supply and return lines 32 (see also FIG. 1) the arrows indicate that paint enters at the inboard portal and flows to and through the connecting channel 53 and thence to and into the applicator channel 38, with a portion of the flow returning and recirculating to and through outlet channel 54 and back to the supply reservoir through the right-most outboard portal. In FIG. 2, this flow to the applicator channel 38 is controlled by microvalve 40, indicated to be in the "open" position, triggered to such by air flow (also indicated by an arrow) into the air inlet line 58. The open and closed configurations of the two microvalves 40 are indicated by the open arrows drawn through their respective actuators 41.

Included in FIG. 2 are two manually operated piston valves 42, one for controlling the flow to each of the microvalves 40. The pistons 42 are threaded at their outermost ends and have a ball cock at their inner ends for shutting off all flow to connecting channels 53 on screwing these valves into their innermost shut off positions. When the valve 42 is adjusted to its closed position, the left microvalve can be removed safely for replacement, as may be required in these applications resulting from clogging or breakage or other malfunction. This closed configuration is illustrated, for the left-hand microvalve 40, in the partial cross-section shown in FIG. 2A. Slot 44 in the outer end of valve 42 facilitates actuation of this valve such as, for example, by twisting using a flat head screwdriver. Compare, e.g., FIGS. 2 and 2A.

Figure 3:
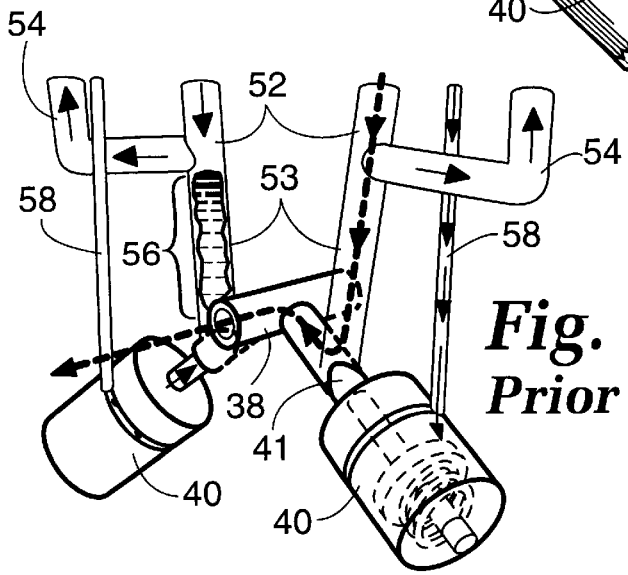
Fig. 3. Prior Art
FIG. 3 is a schematic perspective view of the flow paths of paint flowing through the manifold block of FIGS. 1 and 2 in which paint is recirculating through one pair of inlet-outlet channels and is being directed to the spray atomizer from the other pair of inlet-outlet channels.

FIG. 3 depicts, schematically, the flow paths taken by paint in the left pair of inlet/outlet channels 52, 54, in the non-application, recirculating mode, and for comparison in the right pair of inlet/outlet channels 52, 54, which are in the open, application mode. For the latter, microvalve 40 is open and paint enters inlet channel 52 and flows to and through connecting channel 53 and thence to and into applicator channel 38 for delivery to the atomizer, not shown, this main flow indicated by the dashed arrow. A portion of this paint is recirculated back to the paint reservoir through return channel 54. For the left pair of inlet/outlet channels 52, 54, all of the paint is recirculated, entering as shown through inboard inlet channel 52 and, because microvalve 40 is closed, returning to and through return channel 54, all as indicated by the arrows shown in FIG. 2. In the portion of the connecting channel 53 which is shown broken away, it can be seen and is understood that in this mode of operation the liquid within channel 53 is stagnant, illustrated as 56 in the part of channel 53 which is broken away. The liquid remains in this "dead" space until paint from this particular reservoir is again called for. Residing in such stagnant regions for extended periods of time for temperature sensitive fluids such as paint can be detrimental to the quality of the applied coating, and should be avoided to the extent possible.

Figure 4:
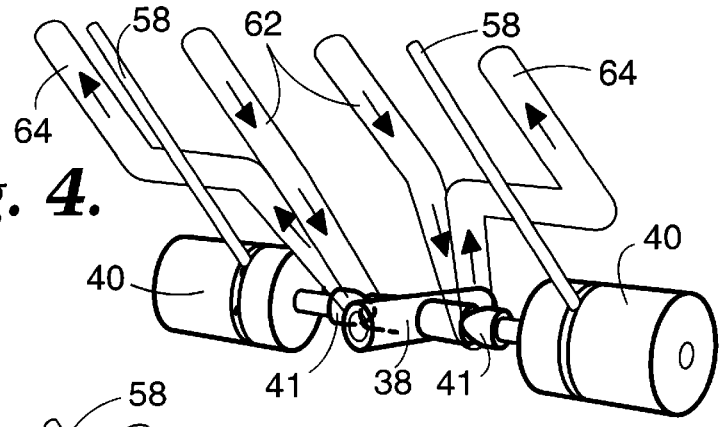
FIG. 4 is a schematic perspective view of the flow paths of liquid (paint) flowing through one manifold block in a recirculating mode in a preferred embodiment of the present invention.
Figure 5:
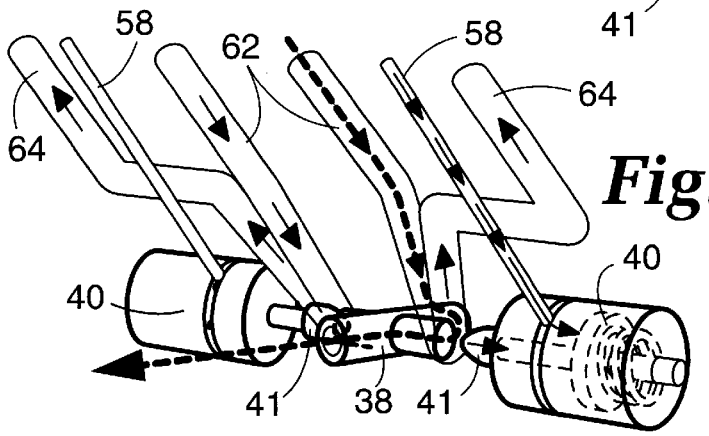
FIG. 5 illustrates the flow paths of the liquids as in FIG. 4 but wherein one microvalve is actuated and paint is routed into and through the applicator channel leading to the spray atomizer (not shown), all as indicated by the dashed arrows.
Figure 6:
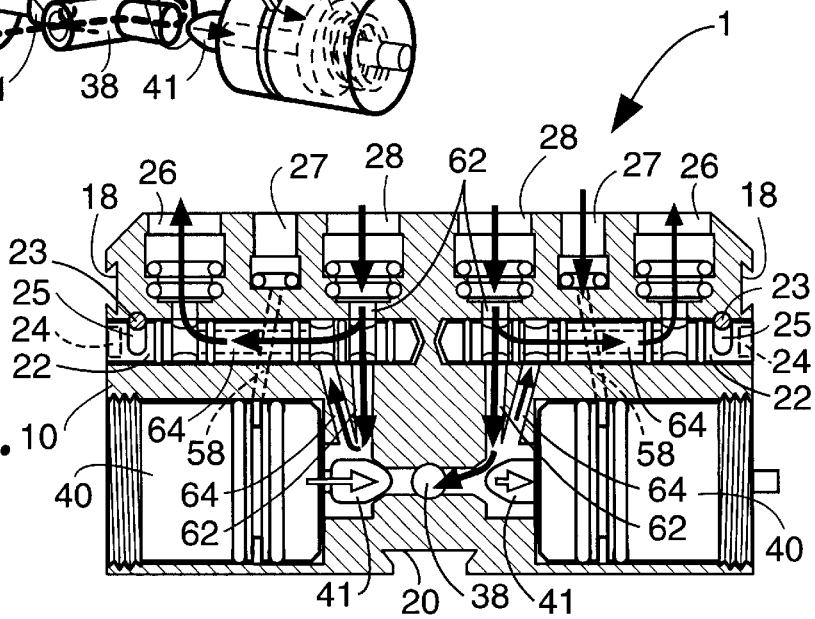
FIG. 6 is a cross-sectional view of one preferred manifold color block of the invention, including two complimentary pairs of inlet and outlet paint channels and two air pilot lines which control the operation of the microvalves.

FIGS. 4, 5, 6 and 6A depict schematically the manifold block according to the present invention. Referring first to FIG. 6, which illustrates in cross-section a manifold block having two complimentary pairs of inboard supply portals 28 and outboard return portals 26, all interconnected as shown by inlet channels 62 and outlet channels 64, the liquid paint is directed through the manifold block depending upon the triggering, or lack thereof, of the left and right microvalves 40, all as indicated by the arrows shown. Directing attention to the right microvalve 40, paint enters portal 28, is directed to and through inlet channel 62 and thence into applicator channel 38, as shown, resulting from microvalve 40 being set to its "open" configuration thereby opening actuator 41 allowing paint to pass into channel 38. A portion of the entering paint is directed back through return channel 64 and is recirculated out through portal 26, the lesser outward flow intended to be indicated by the smaller, flow-indicating arrows.

The configuration and operation of the piston shut-off valves 22 will be described later below. Suffice it to say here that the paint flow therethrough is in the directions indicated by the arrows shown.

Referring again to FIG. 6, the left-hand microvalve 40 has its actuator 41 shut, thereby closing off applicator channel 38. Therefore, the paint flow enters through inboard portal 28 and flows into and through inlet channel 62 and thence all of this flow is directed to and through outlet channel 64, recirculating back to the supply reservoir, not shown, through outboard portal 26. The operation of the microvalves 40 is controlled, as before, by controlling the air supply directed through the air supply lines 58. For completeness, key ways 18, 20 and other details of the block 10 and its auxiliary components are shown in FIG. 6 and are either described in detail below or are self-evident.

Note in FIG. 6 that paired inlet channels 62 and outlet channels 64, and the applicator channel 38, all meet at a common intersection in adjacent proximity to microvalve 40, thereby substantially eliminating stagnation, or "dead" space, in this manifold block 10 of the invention.

FIG. 4 depicts, schematically, the flow paths through the manifold block wherein both microvalves 40 are in the "closed" position. Therein all paint is being recirculated through the block, entering at inlet channel 62 and flowing out (recirculating) at outlet channel 64, for both microvalves 40, all as indicated by the arrows shown.

FIG. 5 illustrates the flow path taken by paint being directed from one color reservoir to the atomizing applicator. This paint, distinguished by the dashed arrows in FIG. 5, of the desired color, enters the inboard inlet channel 62 and flows to the intersection of inlet channel 62, outlet channel 64, and the applicator channel 38, depicted in the right-hand section of the figure. To draw upon this paint source, the right microvalve 40 has been triggered to "open", as shown, and further indicated by the arrows in air line 58 intended to indicate the seal mechanism in microvalve 40 to be set to its "open" configuration, and wherein a portion of the paint is diverted from the main flow path and sent to and through the outlet channel 64. The paint within the left-hand inlet and outlet channels 62, 64 continues to recirculate from and to its reservoir, unchanged from its flow path depicted in FIG. 4, until drawn upon by the triggering of its respective microvalve 40.

Note in FIG. 5 that there are no zones of stagnation within the system. There are no "dead" spaces in any channel in the system.

Figure 7:
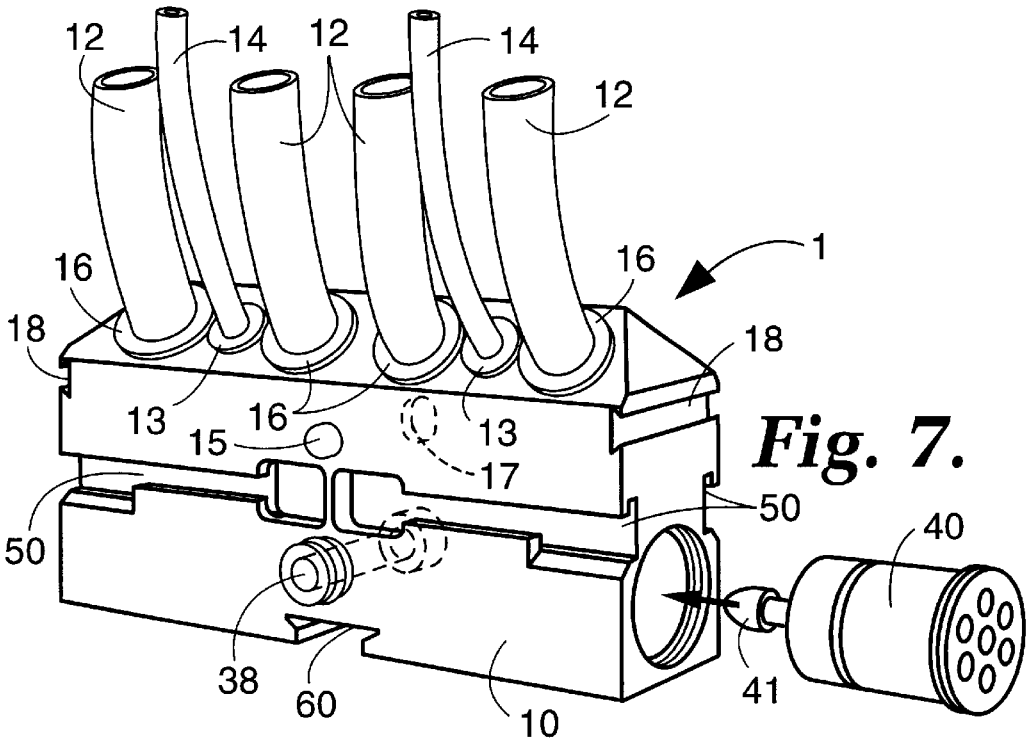
FIG. 7 is an overall perspective of one embodiment of one preferred manifold block according to the invention.
Figure 8:
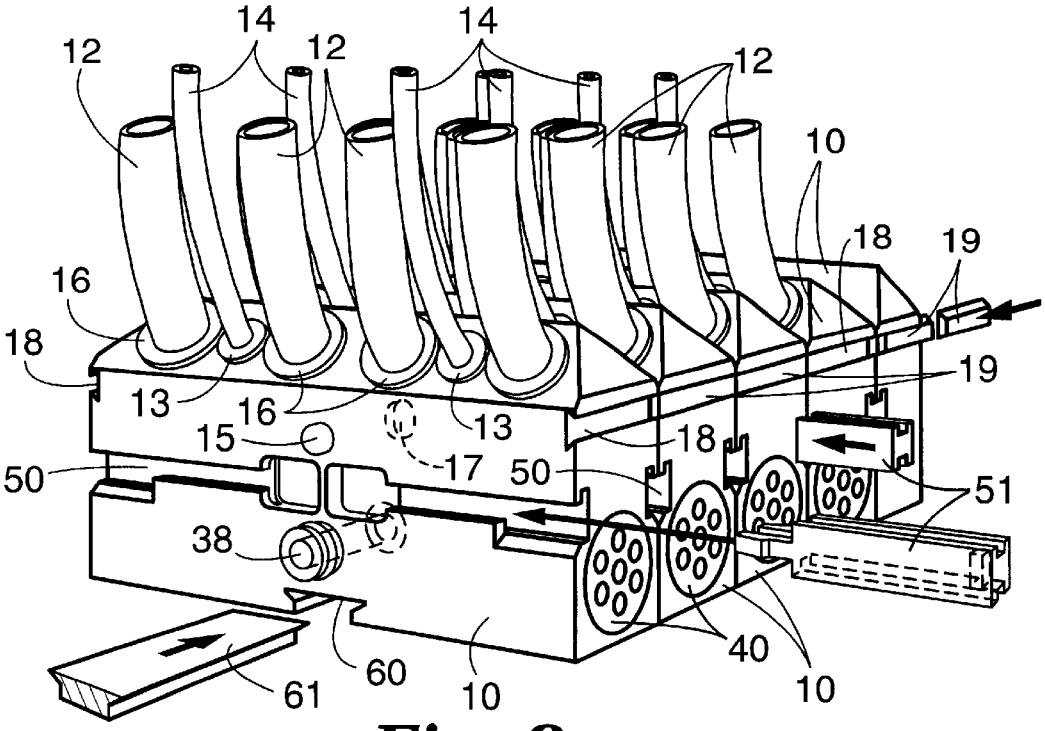
FIG. 8 is a perspective view of an array of the manifold blocks of the invention stacked together to provide for application of a plurality of different liquids, e.g., a plurality of colors of paint.

Refer to FIG. 7 for a perspective view of one manifold color block 10 of the invention and its peripheral attachments, including paint supply and return lines 12, connected to the block 10 by push fittings 16 described below, and air supply lines 14. A microvalve 40 is shown external to block 10 and to be threadingly inserted into the block as indicated by the arrow. For completeness, the end fittings on applicator channel 38 are shown, as are key ways 18, 50 and 60 which, with their respective keys, allow the block 10 to be stacked in a multiple unit array, permitting, e.g., application from a large array of different color paint sources, as is shown in FIG. 8. Note in FIG. 7 that detent 15 and indent 17 permit alignment and coordination of one block 10 (sometimes termed a "slice" 10) with adjacent blocks 10 in the stacked array of FIG. 8. The operation and connectivity of keys 51 and 61 are illustrated in this figure, as are means for color-coding each color block 10 in this array by slipping appropriately colored tabs 19 into the key way 18 to correspond with the same color paint within its adjacent "slice" 10.

The microvalves 40 can clog and otherwise break down, and they must be replaced when that occurs, a not uncommon state in the automotive painting process. Down time can be costly. To minimize this down time, replacement of the valves 40 should be accomplished in as little time as possible, with as little disruption to the system, e.g., paint spillage, air entrainment, as possible. In other words, for each valve 40, its corresponding paint flow must be stopped and isolated from the rest of the system, the microvalve itself must be removed and replaced, and the process restarted, all with minimal upset to the system.

With known manifold color blocks as shown in FIGS. 1–2, this valve replacement procedure is accomplished using the shut-off valve 42, described above in connection with the operation of block 30.

Figure 6A:
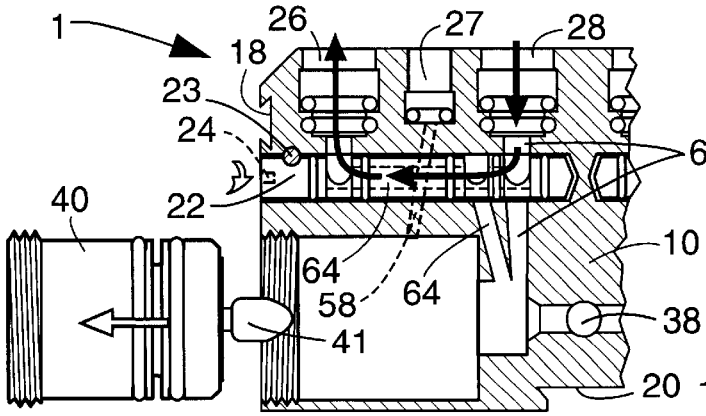
FIG. 6A depicts the flow paths of liquid through the manifold block illustrating the control valve in the "closed" position.
Figure 9:
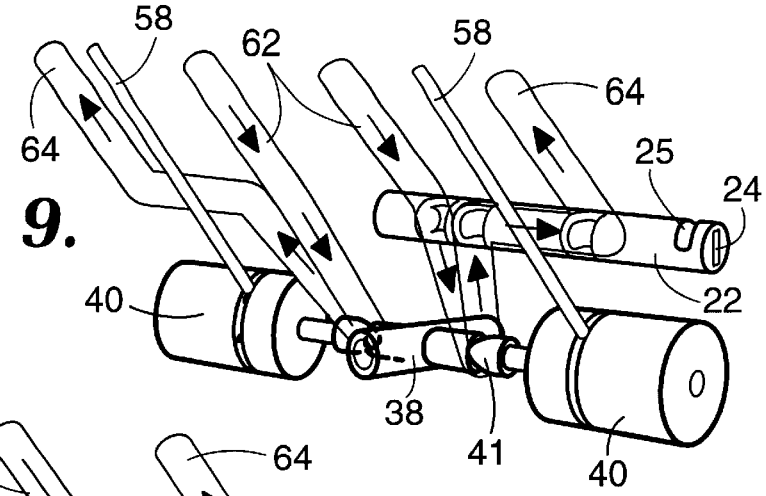
FIG. 9 is a schematic perspective view of the flow paths of liquid flowing through a manifold block of the invention wherein both microvalves of the block are operational and the manual piston valve illustrated is in the "open", flow-through configuration.
Figure 10:
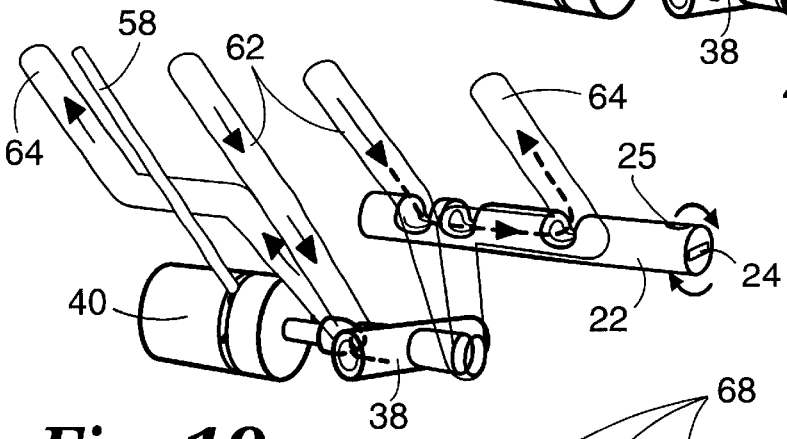
FIG. 10 is a schematic perspective view of the flow paths of liquid flowing through the manifold block of FIG. 9, wherein the manual piston valve is set to the "closed", recirculation position, and wherein the right-hand microvalve has been removed for replacement.
Figure 11:
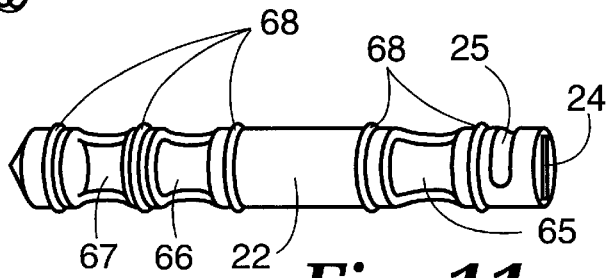
FIG. 11 is a perspective view of one preferred manual piston valve.

For the present manifold block, a manually operable piston valve 22 shut-off, which permits shut down of its corresponding microvalve 40, while maintaining continuous flow with little or no stagnation, is depicted in FIGS. 9–11, and operationally in the cross-sectional views of FIGS. 6 and 6A. This valve 22, shown isolated in FIG. 11, is of the piston type and is inserted into a cylindrical opening within the block 10. This valve 22 is in the form of the tube shown, capped at both ends, and having openings 65, 66 and 67 in its side wall, as shown in FIG. 11. "O"-rings 68 provide for a snug and leak free insertion of valve 22 into block 10. Slot 24 in the end of valve 22 permits its rotation by means of a simple screwdriver. Circumferential groove 25, which extends only 90° about the circumference of valve 22, permits valve 22 to turn only 90° , thereby converting it from its "open" to its "closed" configuration, and vice versa.

When valve 22 is open, the flow paths through it are as depicted in FIG. 9, wherein only one of these valves has been shown for clarity of explanation. When replacement of the microvalve 40 is required, the valve 22 is turned through 90° as shown in FIG. 10, and all flow to the applicator channel 38 is stopped. Valve 40 has been removed from the system in FIG. 10. In all other valves, the fluids continue to recirculate. Leakage which may occur through the gap between valve 22 and its housing channel may be minimized by providing very close tolerances between this valve and its housing, and may be further reduced or eliminated by coating valve 22 with an inert, resilient polymeric gasketing material.

Referring back to FIGS. 6 and 6A, valve 22 is shown therein incorporated into block 10. In FIG. 6, the flow paths of the paint flowing therethrough are indicated by the arrows leading through inlet channel 62, outlet channel 64, applicator channel 38 and the valve 22 in its "open" position. FIG. 6A shows the paths of flow through the block 10 and valve 22 when the latter is "closed", i.e., it has been turned through 90° as indicated by the open arrow, retained thereat by detent 23 in groove 25, and flow is continuously recirculating with no flow to the applicator channel 38. As stated, opening and closing of valve 22 is accomplished by twisting it through 90° using a screwdriver inserted into slot 24, the rotation of which is determined by the limits imposed by detent 23 acting in the 90° circumferential groove 25.

Figure 12:
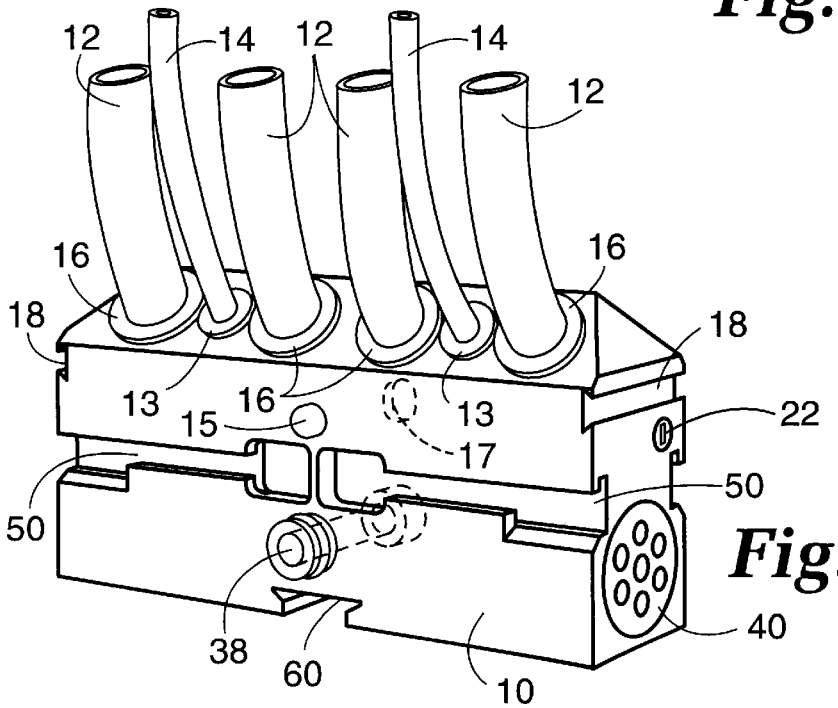
FIG. 12 is an overall perspective view of one preferred manifold block of the invention in a fully operational configuration.

FIG. 12 shows the reassembled block 10 as before, with valve 22 returned to its "open", operational configuration.

Figure 15:
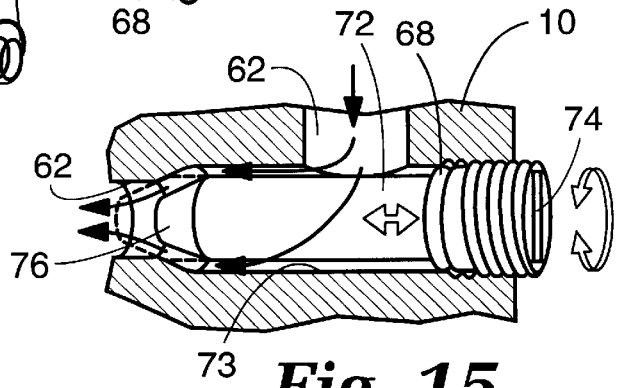
FIG. 15 is a perspective view of the manual piston valve depicted in FIGS. 13–14.

An alternate on-off piston valve 72 is depicted in FIG. 15. This valve, like that shown in FIG. 11, inserts into a cylindrical opening in block 10 and is secured thereat by threads at its outside end. The valve 72 has a tapered end 76 as shown, which, upon twisting of valve 72 clockwise, progresses inwardly until the tapered end 76 seats against the stepped opening into inlet channel 62 from the cylindrical opening 73, indicated in phantom, thereby sealing off channel 62. The valve 72 is sized with a smaller diameter than its cylindrical opening 73 so as to allow the liquid to flow in the annular space between the valve 72 and the opening wall 73, as indicated by the arrows in FIG. 15. Sealing by valve 72 is effected by turning it, as with a screwdriver applied to slot 74.

Figure 13:
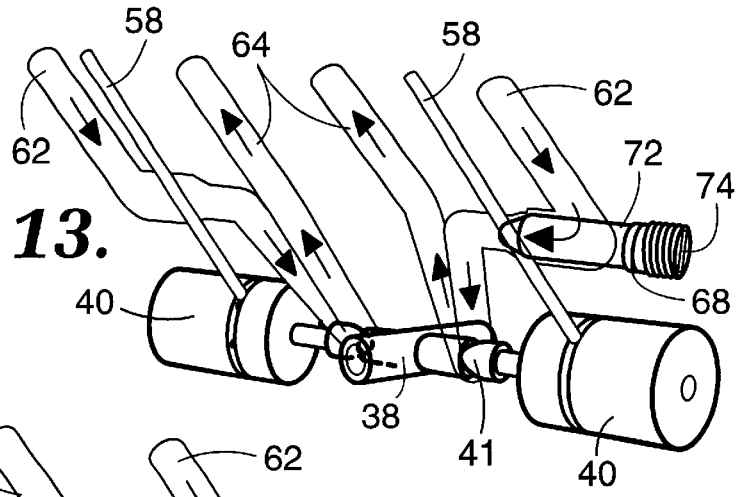
FIG. 13 is a schematic perspective view of the flow paths of liquid flowing through a manifold block of the invention wherein both microvalves are operational and illustrating another embodiment of manual piston valve employed therein.
Figure 14:
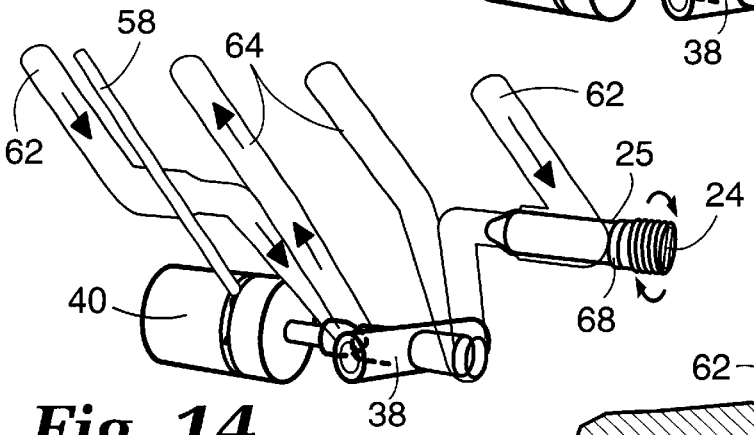
FIG. 14 shows the flow paths of the embodiment of FIG. 13, wherein the manual piston valve of this embodiment is set to the "closed" position and the right-hand microvalve is removed for replacement.
Figure 16:
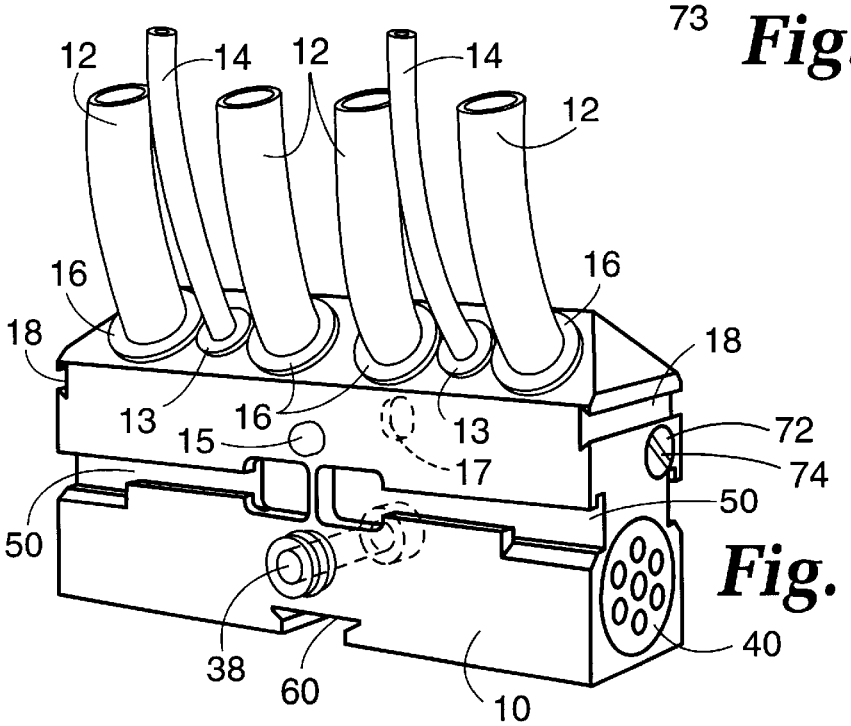
FIG. 16 is a perspective view of the manifold block of the invention incorporating the alternate piston valve, all in its operational mode.

Using the manual check valve 72 of FIG. 15 provides for the flow paths depicted in FIGS. 13 and 14, in a sequence wherein flow to the right hand microvalve 40 is shut off and the valve is removable for replacement. Note in these figures that the supply and return lines 62, 64 have been reversed in flow direction from those shown in FIGS. 9 and 10 in order to accommodate the valve 72 and its operation. In FIG. 13, paint flows from the outboard supply line into and through inlet channel 62 and then through the aforesaid annular spacing, thence out through the outlet channel (inboard here) 64. To change microvalve 40, piston valve 72 is twisted clockwise to advance inwardly, as shown in FIG. 14, thereby sealing off the inlet channel 62 and stopping all flow into the block at that point. The right hand microvalve 40 is shown in FIG. 14, and changing it proceeds as before. The completed block, with valve 72 replaced and operation resumed, is depicted in FIG. 16.

Figure 17:
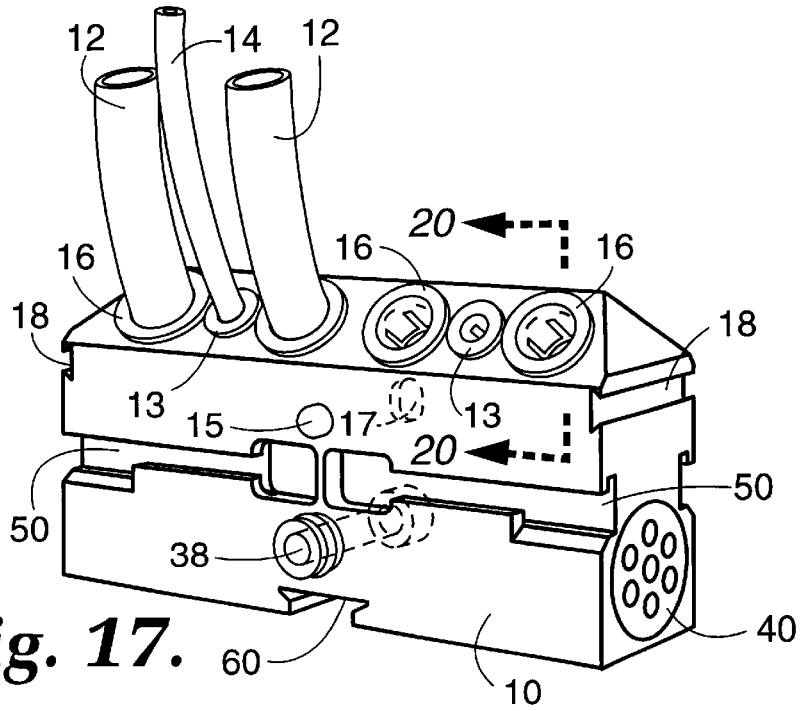
FIG. 17 is a perspective view of the manifold block of the invention with one set of the paired supply and return lines removed to expose and illustrate the push fittings employed in the preferred embodiment.
Figure 18:
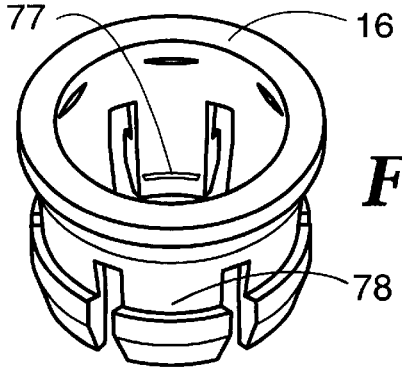
FIG. 18 is a perspective view of a push fitting removed from the manifold block shown in overall view of FIG. 17.
Figure 19:
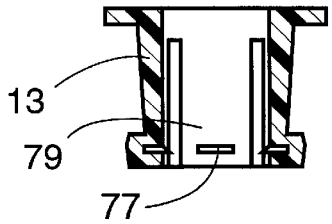
FIG. 19 is a cross-section of the push fitting of FIG. 18.

FIG. 17 shows a modular manifold block 10 of the invention wherein a fitting 16 especially suited for connecting the supply lines 12 to the inlet and outlet channels 62, 64 is employed. In contrast to the known compression fittings described above, fittings 16 are push fittings insertable into block 10 as shown, inserted into cavities machined directly into the body of block 10. The fittings 16 are inserted into these openings and supply line 12 is then inserted through the push fitting top, and through two "O"-rings within the cavity. The push fitting top and cavity are constructed such that, if a hose line is pulled away from the block 10, the push fitting top will increase its grip on the hose and restrain it from pulling out of the block. This may be further enhanced by gripping members 77, encased in fitting 16 as shown in FIGS. 18 and 19. These members 77 may be steel, gripping "teeth" like members.

Figure 20:
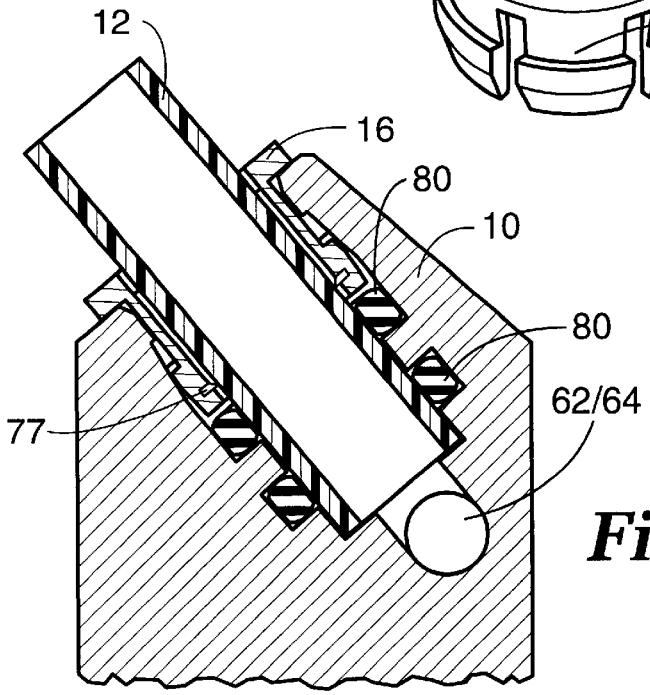
FIG. 20 is a cross-section of the manifold block and push fitting taken substantially along the line 20—20 of FIG. 17.

As can be seen in FIGS. 18–20, each fitting 16 has flexible extensions 78 which are inserted into the cavities in block 10 and fit snugly therein. In FIG. 20, the fitting 16 rests on "O"-ring 80 and has inserted therethrough the hose supply line 12 through which paint flows to channels 62 or 64. The "O"-rings 80 within the cavity ensure that fluid (paint) will not leak out of the fitting and help secure the hose 12 within the fitting 16. These fitting cavities may be machined to accommodate several hose diameters, e.g., 3/16, 1/4, 3/8, 1/2 inch hoses, or 8, 9 and 10 mm hoses, for example. These push fittings 16 allow the hoses 12 to twist, yet hold them securely within the manifold block body 10 without substantial paint leakage, and greatly reduce the likelihood of hoses breaking.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A manifold block housing a plurality of paired inlet channels and outlet channels formed in the block housing and a single applicator channel in microvalved connection with each respective pair of said inlet channels and said outlet channels, each said inlet channel meeting its paired outlet channel at a common intersection of said channels located within a valve chamber of a respective microvalve with said applicator channel in adjacent proximity to said microvalve, wherein, when a microvalve is triggered to the "open" position, the liquid flows through said proximate inlet channel, to and through the applicator channel, with a portion thereof flowing to and through said paired outlet channel and, when said microvalve is triggered to the "closed" position, the liquid flows to and through the proximate inlet channel, and recirculates to and through its paired outlet channel, with no liquid flow to or through the applicator channel, thereby substantially eliminating stagnation in any of said channels in either the "open" or "closed" mode of operation of any of said microvalves.

2. The manifold block of claim 1 having two sets of paired inlet channels and outlet channels, each inlet channel meeting its paired outlet channel at a common microvalved intersection of said channels with said applicator channel in adjacent proximity to one of a pair of said microvalves.

3. A stacked array of a plurality of the manifold blocks of claim 2 interconnected through a common applicator channel.

4. A stacked array of a plurality of the manifold blocks of claim 1 interconnected through a common applicator channel.

5. The stacked array of manifold blocks of claim 4 having each liquid supply line and each liquid return line connected, respectively, to said inlet channels and said outlet channels by means of push fittings.

6. The manifold block of claim 1 having liquid supply lines and liquid return lines connected, respectively, to said inlet channels and said outlet channels by means of push fittings.

7. The manifold block of claim 1 having incorporated therein a plurality of manual piston valves, each channeled to interconnect one pair of said inlet, outlet and applicator channels in an operational application mode, and to interconnect only said inlet and outlet channels, but isolating and closing off said applicator channel, in a nonoperational non-application mode, thereby enabling stoppage of flow to said applicator channel while simultaneously allowing recirculation of flow through said paired inlet and outlet channels and isolating and enabling replacement of said proximate microvalve with minimal disruption of operation and spillage of liquid, when configured to the nonoperational mode.

8. The manifold block of claim 7 wherein each said manual piston valve includes means for twisting said piston valve 90° about its axis, to thereby transform said valve from its operational mode to its nonoperational mode.

9. The method of use of the manifold block of claim 1 in the spray painting of automotive vehicles.

10. The method of use of the manifold block of claim 1 in the application of a coating upon a substrate, said coating selected from the class consisting of paint, dye, acid, caustic, a fragrance, soap, detergent, powders in powder coating applications and a process chemical.

* * * * *